United States Patent [19]

Zona

[11] Patent Number: 4,567,677

[45] Date of Patent: Feb. 4, 1986

[54] WATER FILLED SHOE INSOLE

[75] Inventor: James Zona, Allison Park, Pa.

[73] Assignee: Pittsburgh Plastics Manufacturing, Pittsburgh, Pa.

[21] Appl. No.: 645,332

[22] Filed: Aug. 29, 1984

[51] Int. Cl.[4] ..... A43B 13/40

[52] U.S. Cl. ..... 36/43; 36/30 A; 36/28

[58] Field of Search ..... 36/43, 30 A, 28, 29, 36/44

[56] References Cited

U.S. PATENT DOCUMENTS

| | | | |
|---|---|---|---|
| D. 246,486 | 11/1977 | Nickel | D2/318 |
| D. 255,060 | 5/1980 | Okazawa | D2/318 |
| 1,093,608 | 4/1914 | Delaney | 36/43 |
| 3,795,994 | 3/1974 | Ava | 36/29 |
| 3,871,117 | 3/1975 | Richmond et al. | 36/43 |
| 3,922,801 | 12/1975 | Zente | 36/44 |
| 4,115,934 | 9/1978 | Hall | 36/44 |
| 4,471,538 | 9/1984 | Pomeranz et al. | 36/43 |

*Primary Examiner*—Henry S. Jaudon
*Assistant Examiner*—Mary A. Ellis
*Attorney, Agent, or Firm*—Eric P. Schellin

[57] ABSTRACT

An insole comprising a bladder which is filled with a water and air, and having a metatarsal and heel area for cushioning the foot of the user. Flow restrictions are located between the metatarsal and heel area of the bladder so as to restrict the flow of water and air from the metatarsal area to the heel area and vice versa. The flow restrictions are C-shaped seals in the bladder and provide a massaging action for the foot of the user.

11 Claims, 2 Drawing Figures

WATER FILLED SHOE INSOLE

BACKGROUND OF THE INVENTION

1. Field of the Invention

The present invention is directed to a podiatric insole which forms a cushion in contact with the bottom of a user's foot. More specifically the invention is directed to a liquid-filled insole having gating means for restricting the flow of liquid from one portion of the insole to another portion of the insole.

2. Description of the Prior Art

It has long been known to provide an insole to cushion the impact of a person's foot with a supporting surface. For example, a decorative insole is disclosed in U.S. Pat. No. Des. 255,060 to Okazawa. It has also been known to provide a greater cushioning effect by forming the insole from a liquid-filled bladder which may contain water or another liquid. Liquid filled insoles are disclosed in U.S. Pat. Nos. 3,990,457, to Voorhees, 4,115,934, to Hall, and U.S. Pat. No. Des. 246,486 to Nickel. Such insoles are usually provided with individual compartments for holding liquid and the compartments do not communicate with one another.

To provide a massaging action on the bottom of a person's foot, the insole may be partially filled with a liquid, so that the liquid is free to slosh from one area of the insole to another area during movement of the foot. Such an insole is disclosed in U.S. Pat. No. 4,100,686 to Sgarlato et al. In Sgarlato et al the liquid may flow from front to back collecting at the heel or the toe.

In the Voorhees insole mentioned above, the importance was recognized of providing a liquid cushion to the load supporting surfaces of the foot; and more particularly providing individual liquid filled compartments for each of the load supporting areas. Body weight is transmitted to specific weight bearing surfaces of the foot. The weight is transmitted through the longitudinal and transverse arches to predominately three areas. These areas are the heel, the metatarsal region or the ball of the foot, and the outer border of the arch. The toes do not in themselves carry a significant portion of the total body weight.

U.S. Pat. No. 3,765,422, to Smith, discloses a fluid filled podiatric insole which is provided with flow directors for directing the flow of fluid within the insole. The directors are formed by sealing the top layer of the insole to the bottom layer of the insole. As in the Voorhees and Hall insoles, the metatarsal region of the insole is sealed off from the rest of the insole to prevent fluid from flowing from the heel portion to the metatarsal portion.

SUMMARY

It is the object of the present invention to provide an insole comprising a bladder filled with water and air that cushions the supporting areas of the foot while also transmitting a massaging action to the bottom of the foot.

The insole of the present invention comprises a bladder formed from two sheets of plastic sealed around their circumference which is in the shape of a foot. The bladder is filled with a liquid, such as water, and air so that the liquid may slosh back and forth in the bladder providing a massaging action. Between the metatarsal area of the bladder and the heel area of the bladder there is provided a gating means. The gating means forms a restriction for the flow of liquid from one area to another.

The gating means is formed by sealing the plastic together at selected points to reduce the flow area between the metatarsal area and the heel area of the bladder. As such the gating means forms a flow restriction between the areas to restrict the flow of liquid from one area to another and thereby provide overall cushioning of the supporting areas of the foot while also providing the massaging action of the bladder.

DETAILED DESCRIPTION

Figure 1:
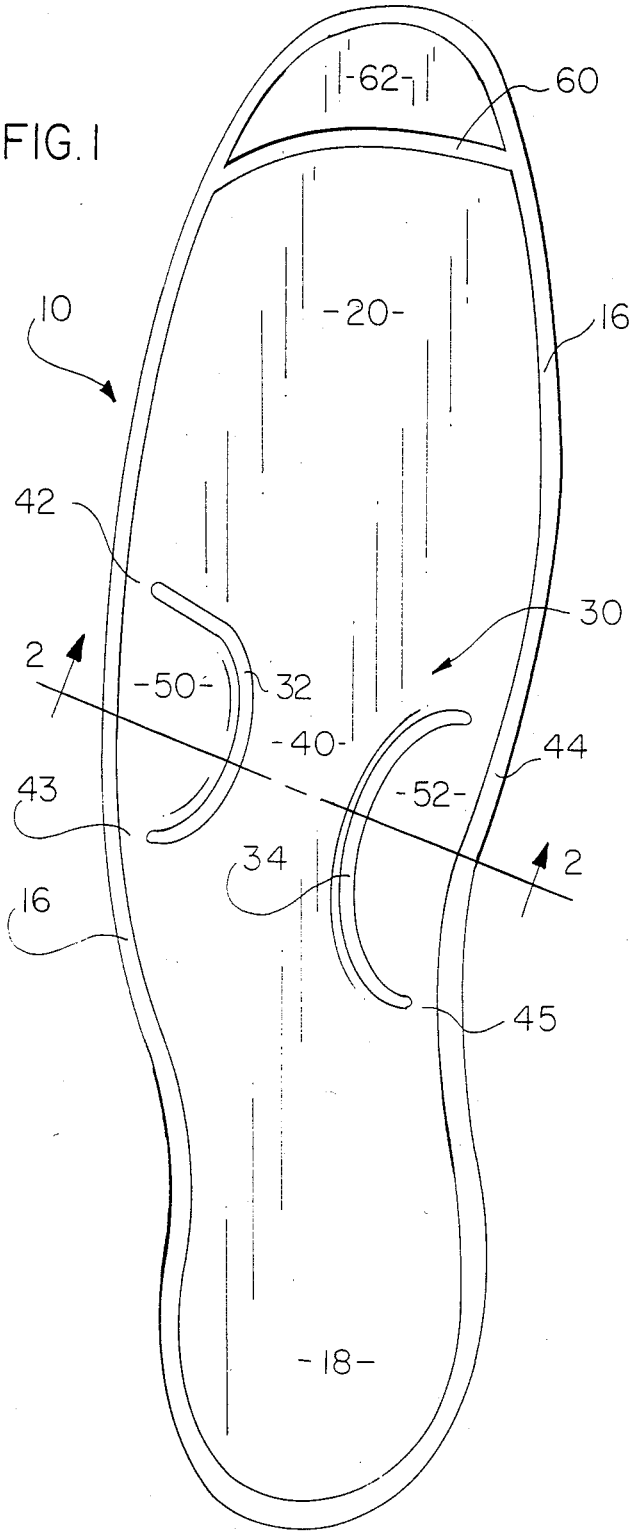
FIG. 1, is a overhead view of the insole.

As illustrated in FIG. 1, insole 10 of the present invention, is in the shape of a foot. The insole is essentially a bladder formed by two plastic sheets 12 and 14 sealed around the circumference of the insole at 16. The bladder forms a chamber which is partially filled with a liquid, such as water, and the remainder of the chamber is filled with air.

Figure 2:
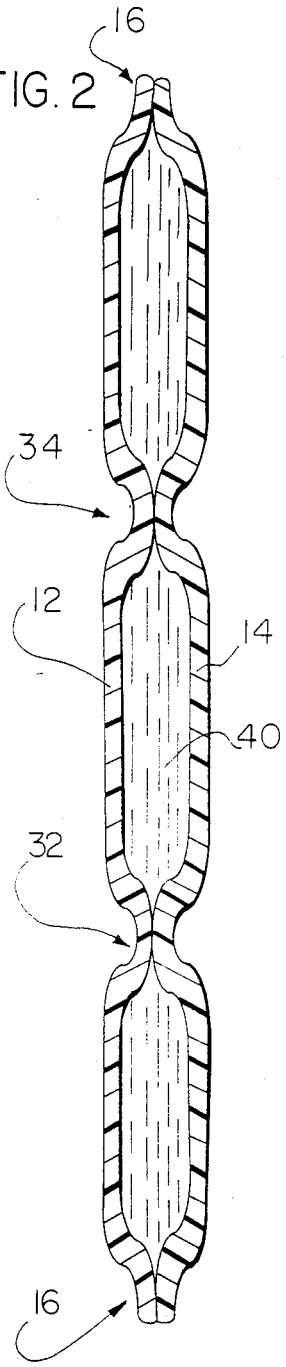
FIG. 2, is a cross section view of the insole taken along line 2—2.

The insole is divided into two main areas, heel area 18 and metatarsal area 20. Between these two areas is gating means 30 which comprises two C-shaped restrictions 32 and 34 which restrict the flow of liquid between the two main areas. The restrictions are formed by sealing plastic sheet 12 to sheet 14, as illustrated in FIG. 2. The restrictions form a restricted main flow passage at 40 and four small passages at 42-45. In addition the C-shaped arrangement of the restrictions form bladder areas 50 and 52 which restrict the liquid from all collecting at the arch when pressure is evenly applied by the foot. Furthermore, area 50 provides a cushioning area for the outer border of the arch and specifically for the tuberosity existing on the lateral side of the fifth metatarsal bone.

While walking the heel of a person contacts the top of the insole driving fluid from the heel area to the metatarsal area. However, because of the gating means, the flow of liquid is slowed thereby providing a liquid cushion under the heel for a longer period of time. As weight is transferred from the heel to the metatarsal region of the foot the liquid is driven from the metatarsal region of the insole back to the heel through the gating means. As will be recognized, the flow of liquid between the main areas of the insole will be slowed resulting in a liquid cushion being located under the load supporting area of the foot for a longer period of time. In addition the sloshing of the water and air mixture results in a massaging action for the bottom of the foot.

During walking the stress or pull on the insole occurs from toe to heel. More specifically, as the foot moves in the shoe, the foot stretches the insole toe to heel, putting a stress on the insole. This stressing action can break seams located between the heel and toe. In the present invention the C-shaped arrangement of gating means substantially reduces or eliminates this problem by locating the start and end of each C-shaped restriction near the outside seam of the insole pointing away from the primary stress area.

Seam 60 is formed similarly to the rest of the seals, and seals toe area 62 from the remainder of the insole. The toe area is not air tight and is not filled with liquid because the toes do not support a significant portion of the body weight. Therefore seam 60 together with seam 16 defines the outer boundary of the liquid containing portion of the insole.

The above described embodiment of the invention provides a useful and comfortable insole, however the invention should not be limited by the above disclosed embodiment, but should be solely limited by the claims that follow.

I claim:

1. A liquid containing insole for supporting the sole of a foot of a user, said insole comprising:

a sealed bladder forming therein a chamber containing a mixture of a liquid and a gas, the bladder having an outside edge in the shape of a sole of foot, and the bladder is provided with a metatarsal area and a heel area; and gating means located between the metatarsal area and the heel area of the bladder, the gating means forms a means for restricting the flow of the liquid and the air between the metatarsal area and the heel area, the gating means comprises a first C-shaped restriction located between the metatarsal and heel area of the bladder which forms an area for cushioning the tuberosity on the lateral side of the fifth metatarsal bone, and the gating means comprises a second C-shaped restriction located transversely across the bladder from the first restriction, whereby a main flow passage is formed between the first restriction and the second restriction, the main flow passage is used to transmit liquid from the heel area to the metatarsal area and visa versa, the first and second C-shaped restrictions are provided with the open side of the C facing outwardly from the main flow passage, the C-shaped restrictions are each spaced from the edge of the bladder.

2. An insole as defined by claim 1 wherein the gating means comprises a first restriction located between the metatarsal and heel area of the bladder which forms an area for cushioning the tuberosity on the lateral side of the fifth metatarsal bone.

3. An insole as defined by claim 2 wherein the gating means comprises a second restriction located transversely across the bladder from the first restrictions.

4. An insole as defined by claim 3 wherein a main flow passage is formed between the first restriction and the second restrictions, the main flow passage is used to transmit liquid from the heel area to the metatarsal area and vica versa.

5. An insole as defined by claim 4 wherein the first and second restrictions are C-shaped with the open side of the C facing outwardly from the main flow passage.

6. An insole as defined by claim 5 wherein the C-shaped restrictions do not contact the edge of the bladder.

7. An insole as defined by claim 1 wherein said bladder comprises two plastic sheets that overlie one another forming the chamber therebetween, and the plastic sheets are sealed along the outside edges to seal the chamber of the bladder.

8. An insole as defined by claim 7 wherein the restrictions are formed by sealing the two plastic sheets to one another.

9. An insole as defined by claim 8 wherein the bladder is provided with a toe area adjacent the metatarsal area that is sealed from the metatarsal area by a seal.

10. An insole as defined by claim 7 wherein additional flow passages are formed between the flow restrictions and the outside edge of the bladder.

11. An insole as defined by claim 10 wherein the liquid is water and the gas is air.

* * * * *